United States Patent [19]

Page et al.

[11] Patent Number: 4,604,936

[45] Date of Patent: Aug. 12, 1986

[54] SNAP-IN VIBRATO ARM

[75] Inventors: John F. Page, La Mirada, Calif.; Helmut Schaller, Feucht, Fed. Rep. of Germany

[73] Assignee: Fender Musical Instruments Corporation, Brea, Calif.

[21] Appl. No.: 689,715

[22] Filed: Jan. 4, 1985

[51] Int. Cl.[4] ..... G10D 3/12

[52] U.S. Cl. ..... 84/313

[58] Field of Search ..... 84/313; 411/288

[56] References Cited

U.S. PATENT DOCUMENTS

| | | | |
|---|---|---|---|
| 1,839,395 | 1/1932 | Kauffman | 84/313 |
| 2,221,961 | 11/1940 | Allen et al. | 411/288 |
| 2,972,923 | 2/1961 | Fender | 84/313 |
| 3,139,783 | 7/1964 | Grant et al. | 84/411 R |
| 4,171,661 | 10/1979 | Rose | 84/313 |
| 4,512,232 | 4/1985 | Schaller | 84/313 |

*Primary Examiner*—Lawrence R. Franklin

*Attorney, Agent, or Firm*—Gausewitz, Carr & Rothenberg

[57] ABSTRACT

The pivoted bridge and string securing assembly (26) of a stringed guitar is operated to produce a vibrato sound by means of a handle (96) that is both detachable and rotatably adjustable. A hollow bolt (66) is rotatably mounted to a bridging plate (30) of the bridge assembly and provided with a controllably adjustable frictional restraint (80) against rotation. The vibrato handle has a mounting leg (100) received within the bore of the hollow bolt, is keyed (78, 102) to the bolt for frictionally restrained rotation therewith, and is detachably latched to the bolt by a latching spring (106).

15 Claims, 4 Drawing Figures

FIG. 1.
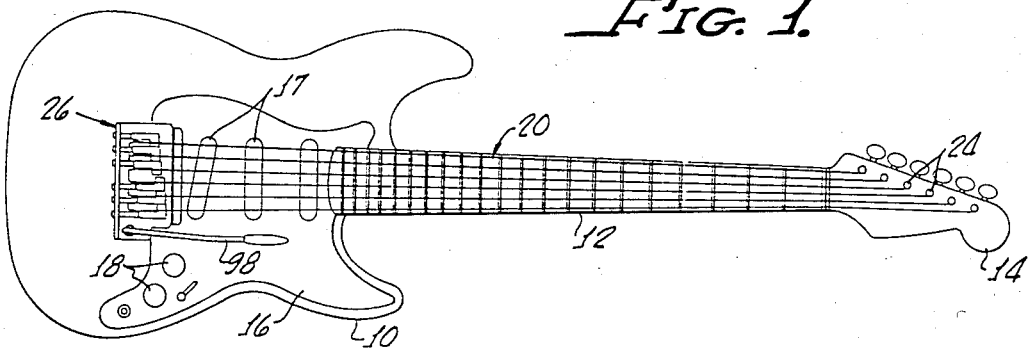
FIG. 2.
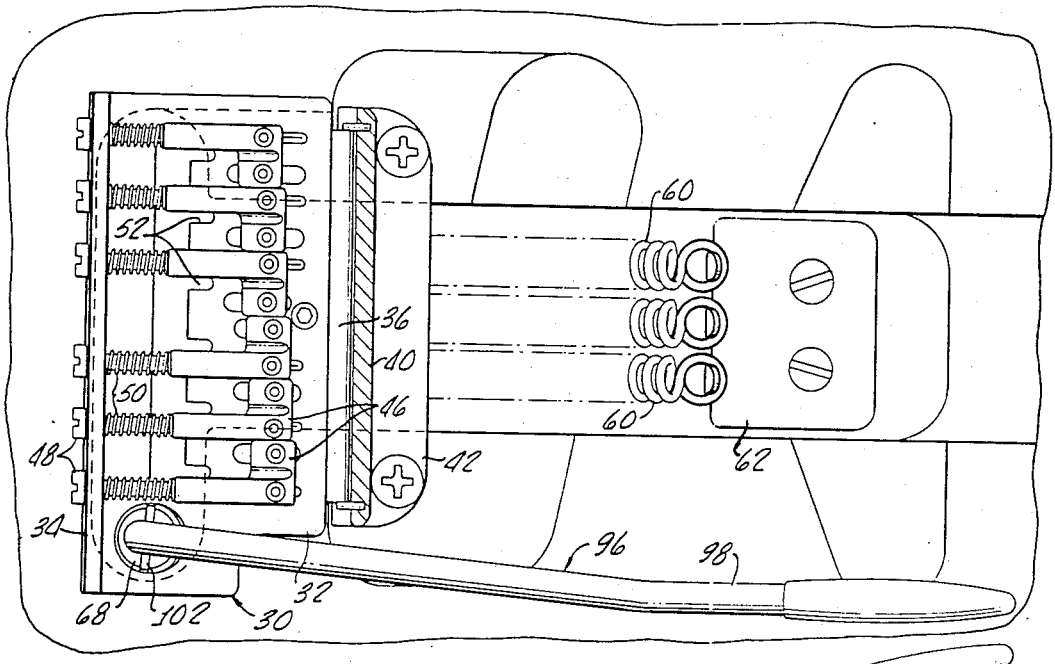
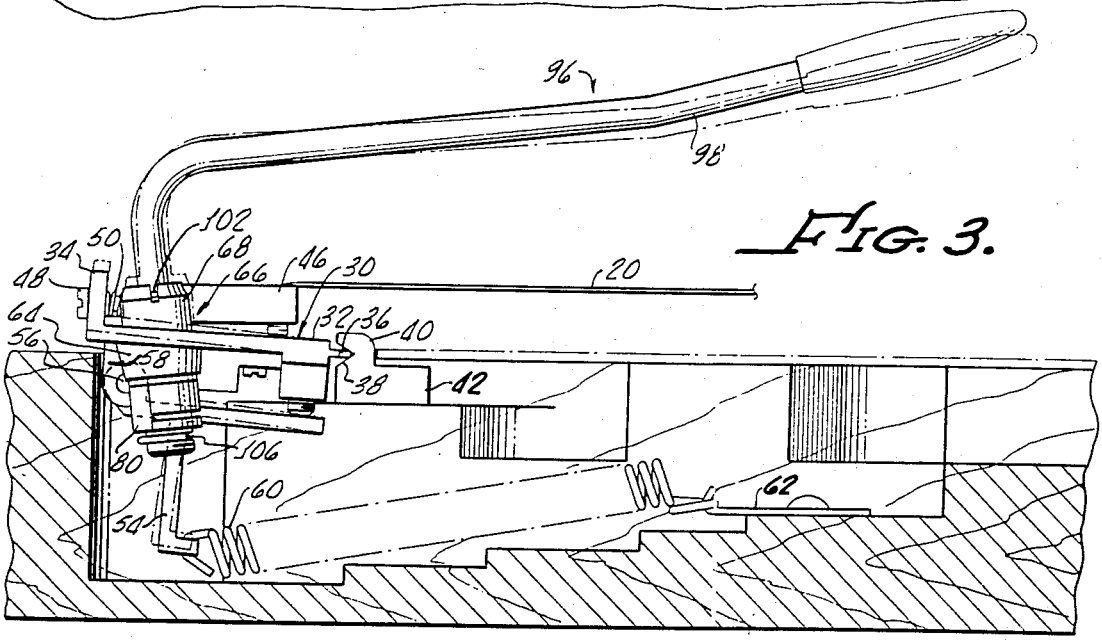
FIG. 3.

SNAP-IN VIBRATO ARM

This is a continuation application of pending prior International Application No. PCT/US83/00,715, International filing date May 6, 1983, of John F. Page and Helmut Schaller, for Snap-In Vibrato Arm, no priority date claimed, now abn.

BACKGROUND OF THE INVENTION

The present invention relates to vibrato operation for stringed instruments, particularly guitars and similar type instruments. In particular, the invention concerns an improved operating handle for effecting vibrato.

Prior vibrato devices for stringed instruments are typified by the various constructions shown in the U.S. patents to C. L. Fender U.S. Pat. Nos. 2,972,923; 3,241,418; and 3,500,711. In these devices, vibrato is achieved by rocking motion of a string plate, or other connecting device, to which one end of the strings are connected. The plate is rocked by means of a generally L-shaped handle, which is secured to the rocking plate by a mechanism designed to permit adjustable rotation of the handle to different positions over the guitar body, such mechanisms either completely preventing removal of the handle or making removal exceedingly difficult, time-consuming, and laborious.

The vibrato handle is a long slender rod that extends generally parallel to and spaced from the guitar body and, thus, comprises a projection which is subject to damage or wear in handling or transporting the instrument. Further, the player may perform music which does not employ vibrato, and such performances would be greatly facilitated by complete removal of the handle. However, connection and disconnection must be quickly and easily accomplished without use of tools.

As mentioned above, the vibrato actuator handle is rotatably adjustable for the convenience of the performer, either before or during a performance. The handle must be easily positioned, as desired, and yet must avoid inadvertent positioning. Prior rotational restraints on handle position are not readily adjustable, may not maintain a constant frictional restraint against rotation, and may not be able to provide an adequate amount of rotational restraint.

Accordingly, it is an object of the present invention to provide a guitar having a vibrato actuator handle that minimizes or eliminates above-mentioned problems.

SUMMARY OF THE INVENTION

In carrying out principles of the present invention in accordance with a preferred embodiment thereof, the movably mounted string-mounting element of a guitar has an actuator handle that is detachably and rotatably connected so that the arm may be moved to different positions and yet may be completely detached. The arm is mounted to a guitar bridge plate by being detachably received in a shaft rotatably mounted to the plate. According to a feature of the invention, the rotatable shaft is formed by a hollow, headed bolt extending through the plate with a locknut on the bolt compressing a washer against the plate to provide a fully controllable and adjustable restraint against rotation of the bolt. The detachable connection of the handle to the hollow bolt includes keying means for preventing relative rotation of the handle and the bolt. A mounting leg of the handle is detachably retained within the bore of the hollow bolt by means of a captured latch spring extending through a slot in the bolt and into a circumferential groove at the end of the handle mounting leg.

BRIEF DESCRIPTION OF THE DRAWINGS

FIG. 1 is a plan view of a guitar having a vibrato actuator handle embodying principles of the present invention;

FIG. 2 is an enlarged fragmentary plane view of the bridge assembly of the guitar of FIG. 1;

FIG. 3 is a vertical sectional view of the bridge assembly; and

DETAILED DESCRIPTION OF THE INVENTION

Figure 4:
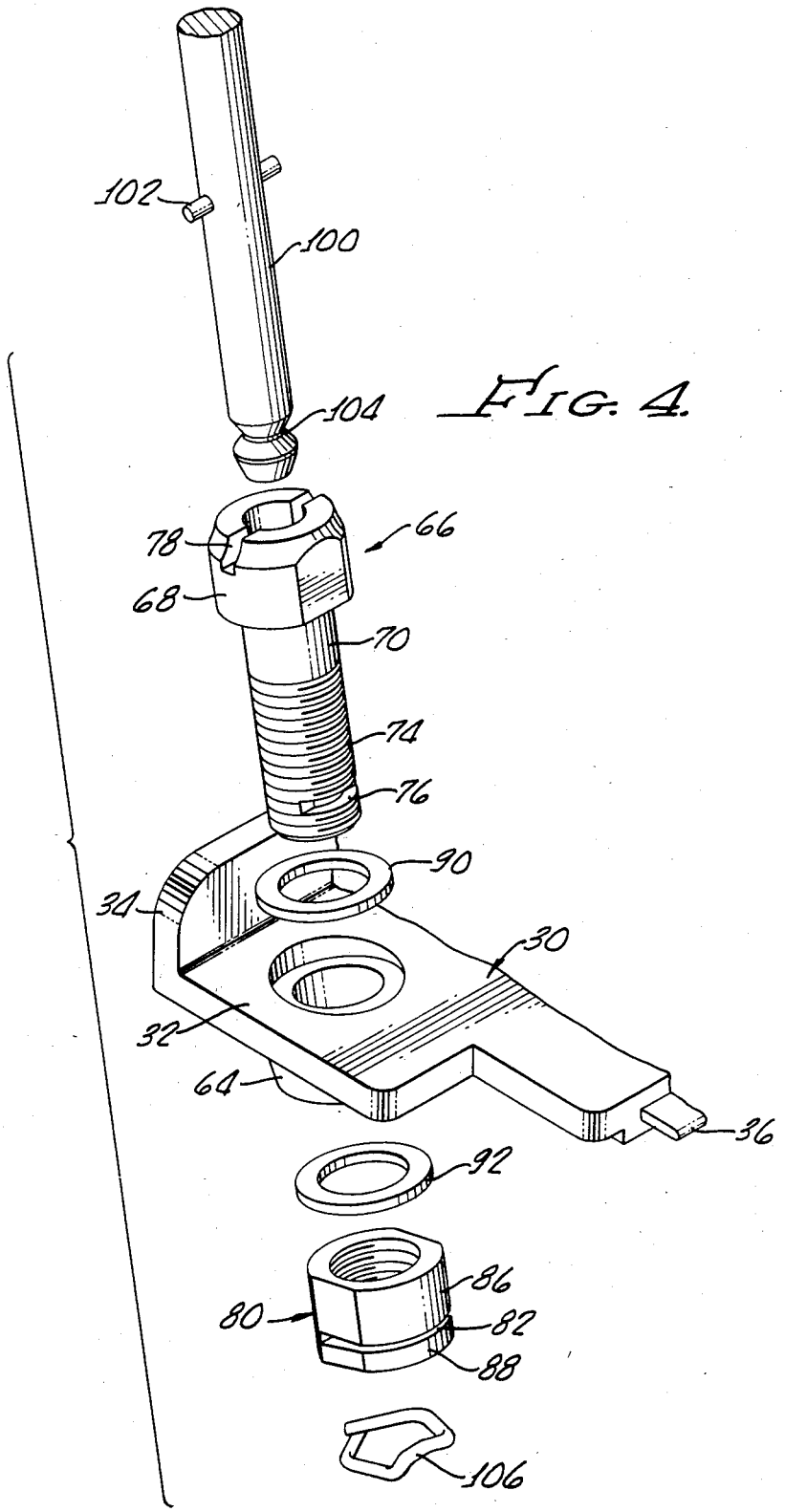
FIG. 4 is an enlarged exploded view showing details of the vibrato actuator handle mounting.

Illustrated in FIG. 1 is a guitar having a body 10, a neck 12, and a head 14. The guitar is illustrated as being of the solid body type, including a finger board or faceplate 16 which is suitably mounted on the upper surface or face of the body 10. Other conventional components include one or more electromagnetic pickups 17 and suitable tone and volume controls 18 adapted to control characteristics of the electrical signal generated by the pickups in response to vibration of the strings, generally indicated at 20. The guitar strings, which are formed of a suitable magnetizable material, are extended and stretched in tensioned relation between tuning screws 24 on head 14 and a bridging assembly, generally indicated at 26. The bridging assembly includes the vibrato mechanism. The arrangement is such that the strings lie generally in a single plane (or on a small section of an imaginery large diameter cylinder) which is generally parallel to the faceplate 16.

A solid guitar body is routed out with suitably-shaped cavities to receive the bridging assembly. As illustrated in FIGS. 2 and 3, the bridging assembly includes a rigid, substantially L-shaped bridging plate 30 having a generally horizontal leg 32 and a relatively short upstanding vertical leg 34. The forward portion of leg 32 fixedly mounts a relatively thin pivot bar 36 having its free end fulcrumed in a slot 38 of the vertical leg 40 of an L-shaped fulcrum plate which is fastened to the guitar body by means of suitable fasteners extending through its horizontal leg 42.

Strings 20 are respectively entrained over individual ones of bridging saddles 46 that are adjustably connected to leg 34 of the bridging plate by means of bolts 48 and springs 50. The ends of the strings 20 are entrained over the bridge saddles and have their ends secured in string connectors, such as a plurality of slots 52, carried on the upper surface of the bridging plate 30. A tensioning bracket 54 is pivoted on a shaft 56 mounted in a pair of depending arms 58 that are fixed to the underside of the bridging plate 30. A plurality of tension springs 60 are connected at one end to the tension bracket 54 and at the other end to a plate 62 fixed to the guitar body.

Springs 60, which are connected under tension, exert a moment on the bridging plate, tending to pivot the latter in a counterclockwise direction (as viewed in FIG. 3) about its fulcrum on the fulcrum plate 40, 42. The tensioned strings, which are connected to the bridging plate on the other side of its pivot shaft 56, exert a moment on the bridging plate that tends to rotate it in a clockwise direction. The spring tensions and the moment arms of both springs and strings are chosen, so that the bridging assembly reaches an equilibrium or balance position, when the strings are normally tuned, with the horizontal arm 32 of the bridging plate extending at a slight upwardly and rearwardly inclined angle from its fulcrum. If the bridging assembly is pivoted in one direction or another by a slight amount from this balance position, the tension of all strings increases or decreases, thus creating the vibrato sound.

An enlarged apertured boss 64 (FIGS. 3 and 4) is formed integrally with, and projects downwardly of, the lower side of horizontal arm 32 of the bridge plate and freely receives a hollow bolt, generally indicated at 66, having a head 68 and a shank. The bolt shank has a smooth unthreaded portion 70 and a threaded end portion 74. A slot 76 extends transversely partly through the threaded shank portion 74 adjacent the bolt end and remote from the bolt head. Head 68 is formed with a plurality of flats to receive a bolt turning tool, and a transverse slot 78 opens longitudinally outwardly of the bolt head, extending completely across the head. A locknut 80 has a transverse slot 82 extending almost all the way across the entire diameter of the nut, dividing the nut into a major or body section 86 and a locking portion 88. The latter is bent downwardly (in unstressed condition of the nut) toward the body portion 86 to thereby distort the internal threads in the locking portion 88. Thus, when the nut is threaded onto the bolt shank, the threads of section 86 turn freely on the bolt, but when the threads of the latching section 88 (which is positioned closer to the free end of the bolt) engage the threads, the prior bending of the section 88 causes its threads to be very tightly engaged with the bolt threads, so that considerable force is required to turn the nut upon the bolt threads. Further, when the nut is turned down along the bolt to a given axial position, it will retain such a position, since latching portion 88 effectively locks the nut upon the bolt and significantly restrains relative rotation.

Friction washers 90, 92 are mounted on the bolt shank and interposed between the bridging plate and the bolt head on one side and between the boss 64 and the locknut on the other. The locknut 80 is turned down to press the washers against the boss and the bridging plate with sufficient force so that rotation of the bolt, locknut and washer assembly relative to the bridging plate is restrained with a frictional torque of adequate magnitude. The amount of such frictional rotational restraining torque is readily increased by tightening the nut 80 upon the bolt. Conversely, the amount of restraining torque may also be decreased by loosening the nut. Nevertheless, the arrangement is capable of a fine adjustment of frictional restraint over an exceedingly wide range of restraint values, and, yet, when once adjusted, will maintain a stable value of such restraint. If it is necessary or desirable to change the amount of rotational restraining torque, one simply turns the locknut up or down along the bolt to increase or decrease the frictional restraint. The restraining torque prevents accidental or hand rotation of the nut, but a pair of wrenches or similar tools readily enables adjustment.

A vibrato actuator handle 96 has a relatively long handle portion 98 which extends almost parallel to, and spaced from, the upper surface of the guitar body and a mounting leg 100, which extends at right angles to the handle arm 98. A projection, such as a pin 102, is fixed to the mounting leg 100, the pin extending through a hole in the mounting leg and being a press fit therein. The pin is received within the transverse slot 78 when the mounting leg 100 is inserted into the bore of the hollow bolt. The end of the latter is formed with a circumferential groove 104 that receives a spring latch 106 captured in the slot 76 of the bolt shank. Spring latch 106 extends through the slot 76 into engagement with the groove 104 of the mounting leg 100, so as to releasably retain the actuator handle 96 to and within the hollow bolt bore.

The plane of the long leg 32 of bridging plate 30 extends at a relatively small angle with respect to the plane of the upper surface of the guitar body when the bridging assembly is in balanced position (as seen in FIG. 3). Accordingly, to ensure that handle arm 98 of the actuator arm extends generally parallel to the upper surface of the guitar body and does not project downwardly, so as to interfere with operation of the strings, the axes of boss 64 and bolt 66 are inclined slightly rearwardly of a vertical (as seen in FIG. 3) so that the mounting leg 100, which is at a right angle to the longitudinal extent of handle arm 98, will also extend rearwardly at a slight angle to the plane of the horizontal leg 32 of the bridging plate.

The detachable handle is readily connected to the bridging plate by inserting the mounting leg 100 into the bore of the bolt and rotating the mounting leg 100 until the locking pin 102 is aligned with the bolt head slot 78 and received thereby. When the pin 102 is in the slot 78, the handle is rotatably locked to the bolt so that any rotation of the handle necessarily rotates the bolt. However, the previously-described controllable and adjustable frictional restraint against rotation of the bolt provides the same controllable and adjustable frictional restraint against rotation of the handle (about the axis of the bolt), because of the interlocking engagement of the pin 102 and slot 78. This allows the handle to be rotationally positioned, as desired by the performer, and ensures that the handle will remain in such position. Nevertheless, the entire handle is readily detached from the bridging plate and bridging assembly (without use of any tools) simply by pulling the mounting leg upwardly to withdraw the leg from the bolt bore. The resilient engagement of the latching spring 106 prevents inadvertent detachment, but allows the handle to be removed with a firm pull. Of course, the handle is readily remounted by simply inserting the mounting leg 100 into the bolt bore with pin 102 aligned with slot 78, until the latch spring snaps into and is received by the groove 104 to latch the handle against axial movement relative to the rotatable shaft or bolt 66.

The foregoing detailed description is to be clearly understood as given by way of illustration and example only, the spirit and scope of this invention being limited solely by the appended claims.

What is claimed is:

1. A guitar-type musical instrument comprising:

a body, a plurality of strings mounted to and extending over said body in tensioned relationship, a string mounting element movably mounted to the body, said strings being connected to the string mounting element so that motion of the string mounting element produces a vibrato sound, said string mounting element comprising a bridge plate pivoted to said body, a vibrato actuator handle for effecting motion of the string mounting element, said handle having an operator arm extending in a direction generally parallel to said body, and means for detachably and rotabably connecting the handle to said string mounting element, said means for connecting the handle comprising a shaft rotatably mounted to the plate and means for detachably connecting the handle to said shaft, whereby the handle may be rotated to move the arm to different positions over said body and may be completely detached without the use of tools.

2. The instrument of claim 1 including means for holding the plate in a balanced position against tension of the strings, said plate extending at an angle to the plane of said body in said balanced position, said handle being mounted to said holding plate for rotation about an axis substantially perpendicular to said body when said plate is in balanced position.

3. The instrument of claim 1 wherein said handle has an attachment portion extending in a second direction substantially perpendicular to the plane of the upper surface of the guitar body and wherein said means for connecting the handle comprises resilient snap-in connecting means for enabling the handle to be attached to and withdrawn from said string mounting element by motion in said second direction.

4. The instrument of claim 1 including means for restraining rotation of said shaft relative to said bridge plate.

5. The instrument of claim 4 wherein said shaft comprises a headed bolt extending through said plate, a nut on said bolt, a washer on said bolt, and means for restraining relative rotation of said nut and bolt.

6. The instrument of claim 5 wherein said plate has an integral boss, said bolt extending through said boss, said means for restraining relative rotation of said nut and bolt comprising a section of said nut partially separated from the rest of said nut by a slot extending partly across the nut, said nut section being bent inwardly to partially close said slot.

7. The instrument of claim 1 wherein said shaft has a bore extending therethrough, said handle having a mounting leg extending through at least a part of said bore, and means for detachably retaining the mounting leg within said bore.

8. The instrument of claim 7 including means for restraining rotation of said shaft, and means for preventing rotation of said mounting leg relative to said shaft.

9. The instrument of claim 8 wherein said means for preventing rotation of said mounting leg comprises a lateral projection on said leg and a slot formed in an end of said shaft and receiving said projection.

10. The instrument of claim 9 wherein said means for detachably retaining the mounting leg comprises a transverse slot extending partly through said shaft, a circumferential groove in said leg, and a retainer spring captured in said transverse slot and engaged with said groove.

11. In a guitar-type musical instrument of the type having a body, a bridge assembly including a bridge plate pivotally mounted to the body, a plurality of tensioned springs connected at one end to the bridge assembly and at the other end to another portion of the guitar body, thereby tending to pivot the bridge plate in a first direction, and a plurality of springs connected between the body and the bridge assembly tending to pivot the bridge plate in an opposite direction, whereby the bridge plate assumes a balanced position under balanced moments caused by the tensioned strings and the tensioned springs, an improved vibrato control comprising a hollow bolt extending through said bridge plate in freely rotatable relation thereto, means for securing the bolt to the plate and presenting a controlled and adjustable restraint against rotation of the bolt relative to the plate, a vibrato actuator handle having a mounting leg extending into said hollow bolt, means for preventing relative rotation of said bolt and mounting leg, and means for detachably securing the mounting leg to the bolt.

12. The apparatus of claim 11 wherein said means for presenting controlled and adjustable restraint against rotation of the bolt comprises at least one washer on the bolt, a nut on the bolt for securing the bolt to the bridge plate and for pressing the washer against the bridge plate with a selectively controllable and adjustable force, and means for restraining rotation of the nut relative to the bolt.

13. The apparatus of claim 12 wherein said means for restraining relative rotation of the nut and bolt comprises a slot extending transversely through a portion of said nut and separating said nut into a body portion and a locking portion, said locking portion being bent toward said body portion to thereby restrain rotation of the nut upon the bolt.

14. The apparatus of claim 12 including interengageable means on said handle mounting leg and said bolt for preventing relative rotation between the leg and bolt.

15. The apparatus of claim 11 wherein said means for detachably connecting said leg portion to and within said bolt comprises a transverse slot extending partly through said bolt, a circumferential groove extending around an end portion of said handle mounting leg and a retaining spring mounted on said bolt and extending through said bolt slot into said groove.

* * * * *